US010403252B2

(12) United States Patent
Chapman et al.

(10) Patent No.: US 10,403,252 B2
(45) Date of Patent: Sep. 3, 2019

(54) SYSTEM AND METHOD FOR CONNECTING AND CONTROLLING MUSICAL RELATED INSTRUMENTS OVER COMMUNICATION NETWORK

(75) Inventors: Keith L. Chapman, Fountain Hills, AZ (US); Charles C. Adams, Gilbert, AZ (US); Stanley J. Cotey, Mesa, AZ (US); Kenneth W. Porter, Scottsdale, AZ (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 1052 days.

(21) Appl. No.: 13/563,643

(22) Filed: Jul. 31, 2012

(65) Prior Publication Data

US 2014/0033900 A1 Feb. 6, 2014

(51) Int. Cl.
*G10H 1/00* (2006.01)

(52) U.S. Cl.
CPC ..... *G10H 1/0083* (2013.01); *G10H 2240/251* (2013.01)

(58) Field of Classification Search
CPC ..... G10H 1/0066; G10H 1/0058; G10H 2240/056; G10H 2240/311; G10H 1/0083; G10H 2240/211; G10H 1/0033; G10H 2240/115; G10H 2250/311; H04W 84/12; H03F 2200/03; H03F 2200/261
See application file for complete search history.

(56) References Cited

U.S. PATENT DOCUMENTS

| | | | | |
|---|---|---|---|---|
| 5,270,475 | A | 12/1993 | Weiss et al. | |
| 5,837,912 | A | 11/1998 | Eagen | |
| 6,191,349 | B1 * | 2/2001 | Flam | 84/609 |
| 6,353,169 | B1 | 3/2002 | Juszkiewicz et al. | |
| 6,632,992 | B2 * | 10/2003 | Hasegawa | 84/609 |

(Continued)

FOREIGN PATENT DOCUMENTS

| | | | |
|---|---|---|---|
| CN | 1624760 | A | 6/2005 |
| CN | 102664001 | A | 9/2012 |

(Continued)

*Primary Examiner* — Marlon T Fletcher
(74) *Attorney, Agent, or Firm* — Robert D. Atkins; Patent Law Group: Atkins and Associates, P.C.

(57) ABSTRACT

A communication system provides connection, configuration, and control of a musical instrument. A musical instrument includes a first communication link disposed on the musical instrument. Various music related accessories, such as a speaker, effects pedal, computer, mobile communication device, and synthesizer, includes a second communication link. A communication link transmits and receives the audio signal and control data between the musical instrument and accessories through the first and second communication links. A controller receives the audio signal and control data for configuring and controlling the device. The communication link is further connected to a computer, mobile communication device, and server through a communication network. A web server interface is coupled to the communication link for user selection and viewing of the control data in human perceive form. A user control interface with one or more webpages is connected to the communication link for configuring the musical instrument and accessories.

35 Claims, 11 Drawing Sheets

(56) References Cited

U.S. PATENT DOCUMENTS 6,686,530 B2 2/2004 Juszkiewicz et al.
6,784,355 B2 * 8/2004 Gyoten et al. ..... 84/622
6,787,690 B1 9/2004 Celi et al.
6,888,057 B2 5/2005 Juszkiewicz et al.
6,914,181 B2 7/2005 Toshitani
7,164,076 B2 1/2007 McHale et al.
7,166,794 B2 1/2007 Juszkiewicz et al.
7,189,911 B2 * 3/2007 Isozaki ..... 84/609
7,220,912 B2 5/2007 Juszkiewicz et al.
7,220,913 B2 5/2007 Juszkiewicz et al.
7,241,948 B2 7/2007 Cummings
7,268,287 B2 * 9/2007 Kawashima ..... 84/600
7,358,433 B2 4/2008 Kondo et al.
7,376,050 B2 * 5/2008 Yanase ..... 368/10
7,399,918 B2 7/2008 Juszkiewicz et al.
7,420,112 B2 9/2008 Juszkiewicz et al.
7,563,977 B2 7/2009 Cummings
7,649,136 B2 * 1/2010 Uehara ..... 84/610
7,741,556 B2 6/2010 Demsey et al.
7,758,427 B2 * 7/2010 Egozy ..... 463/42
7,952,014 B2 5/2011 Juszkiewicz et al.
2001/0037721 A1 * 11/2001 Hasegawa et al. ..... 84/609
2002/0007719 A1 1/2002 Hasegawa
2002/0144587 A1 * 10/2002 Naples ..... G10H 1/365 84/609
2002/0144588 A1 * 10/2002 Naples ..... G10H 1/365 84/609
2003/0000368 A1 * 1/2003 Isozaki ..... 84/609
2003/0024376 A1 * 2/2003 Gyoten ..... G10H 1/0058 84/609
2003/0159570 A1 8/2003 Toshitani
2005/0120865 A1 6/2005 Tada
2007/0017350 A1 * 1/2007 Uehara ..... 84/609
2007/0226293 A1 * 9/2007 Sakurada ..... G10H 1/0058 709/203
2007/0255816 A1 * 11/2007 Quackenbush ..... G10H 1/0058 709/223
2008/0190271 A1 * 8/2008 Taub ..... G10H 1/0058 84/645
2008/0236372 A1 * 10/2008 Uehara ..... G10H 1/0066 84/645
2008/0307949 A1 12/2008 Lee
2009/0070420 A1 * 3/2009 Quackenbush ..... G06F 17/30 709/204
2009/0183622 A1 7/2009 Parash
2010/0031804 A1 2/2010 Chevreau et al.
2012/0017748 A1 * 1/2012 Beck ..... G09B 15/00 84/483.2
2012/0189018 A1 7/2012 Diab et al.
2013/0034240 A1 * 2/2013 Crawford ..... G10H 1/0083 381/77
2013/0180385 A1 * 7/2013 Hamilton ..... G10H 1/0016 84/603
2014/0033900 A1 * 2/2014 Chapman et al. ..... 84/609

FOREIGN PATENT DOCUMENTS

GB 2481879 A 11/2012
WO 2007100798 A2 7/2007
WO 2012058497 A1 5/2012

* cited by examiner

SYSTEM AND METHOD FOR CONNECTING AND CONTROLLING MUSICAL RELATED INSTRUMENTS OVER COMMUNICATION NETWORK

FIELD OF THE INVENTION

The present invention relates to musical instruments and, more particularly, to a system and method for connecting and controlling musical instruments and related accessories over a communication network.

BACKGROUND OF THE INVENTION

Musical instruments have always been very popular in society providing entertainment, social interaction, self-expression, and a business and source of livelihood for many people. Musical instruments and related accessories are used by professional and amateur musicians to generate, alter, transmit, and reproduce audio signals. Common musical instruments include an electric guitar, bass guitar, violin, horn, brass, drums, wind instrument, string instrument, piano, organ, electric keyboard, and percussions. Other electronic sources of music include synthesizers, thermions, and samplers. The audio signal from the musical instrument is typically an analog signal containing a progression of values within a continuous range. The audio signal can also be digital in nature as a series of binary one or zero values.

The musical instrument is often used in conjunction with related musical accessories, such as microphones, audio amplifiers, speakers, mixers, synthesizers, samplers, effects pedals, public address systems, digital recorders, and similar devices to capture, alter, combine, store, play back, and reproduce sound from digital or analog audio signals originating from the musical instrument. The musical instrument is connected to the accessories by audio and control cables, e.g., XLR cables, DIN cables, ¼ inch instrument cables, and AES3 cables, to transmit the analog or digital audio signals and control signals from one device to another. The audio cabling between the musical instrument and accessories requires time and expertise to set up and must remain in place during the musical performance. The audio cabling is expensive and inconvenient to transport, setup, take down, and store between performances. A missing or defective cable without a ready replacement can suspend or delay the musical performance. The audio cabling can form ground loops that introduce power line hum into the audio signals, acting as an antenna that receives unwanted radio frequency (RF) signals. In addition, the cabling is subject to damage from handing and repeated use, often limits the physical mobility of the performer, and presents a safety hazard due to the potential for tripping or electrical shock.

The musical instrument and related accessories typically include hand-operated controls located on a readily accessible panel or surface of the instrument to alter the volume, frequency response, tonal characteristics, and operational state of the instrument or accessory. The number and type of controls vary depending on the type of instrument. For example, an electric guitar may have control switches that select one or more pickups as the source of the audio signal, as well as control knobs that determine the volume and tonal qualities of the audio signal transmitted to an output jack. The electric guitar is connected by an audio cable from the output jack to an audio amplifier. The audio amplifier has a front panel with control knobs, buttons, sliders, and switches for amplification, volume, gain, filtering, tone equalization, sound effects, bass, treble, midrange, reverb dwell, reverb mix, vibrato speed, and vibrato intensity. The user adjusts the knobs, buttons, sliders, and switches on the front panel of the audio amplifier to dial in the desired volume, acoustics, and sound effects. The output of the audio amplifier is connected by audio cable to a speaker to audibly reproduce the sound.

In other examples, a synthesizer includes controls for selecting the instrument being synthesized, effects, automatic accompaniment, and other features. A multi-channel mixer has controls for each input channel, as well as additional master controls that affect each channel. The user controls the instrument or accessory by moving various switches, knobs, and sliders to the desired setting. Generally, a musical performance requires appropriate configuration of a number of controls on different musical instruments and accessories. The controls that must be set and coordinated on the musical instruments and accessories become a time consuming operation, often requiring readjustments during or between performances, and generally difficult to manage when several devices are used together.

SUMMARY OF THE INVENTION

A need exists to connect, configure, monitor, and control musical instruments and accessories. Accordingly, in one embodiment, the present invention is a communication network for connecting and controlling a musical instrument comprising a musical instrument including a first communication link disposed on the musical instrument. An audio amplifier includes a second communication link disposed on the audio amplifier. An access point transmits and receives an audio signal and control data between the musical instrument and audio amplifier through the first communication link and second communication link.

In another embodiment, the present invention is a musical system comprising a musical instrument and first communication link disposed on the musical instrument. A controller is coupled to the first communication link for receiving control data to control operation of the musical instrument and transmitting an audio signal originating from the musical instrument through the first communication link.

In another embodiment, the present invention is a musical system comprising a musical related device including a communication link disposed on the musical related device. A controller is coupled for receiving control data from the communication link to control operation of the musical related device and transmitting an audio signal from the musical related device through the communication link.

In another embodiment, the present invention is a communication system comprising an audio or video device including a communication link disposed on the audio or video device. A controller is coupled for receiving control data from the communication link to control operation of the audio or video device. A web browser interface through the communication link for user selection and viewing of the control data in human perceivable form.

In another embodiment, the present invention is a method of configuring and controlling a musical system comprising the steps of providing a musical related device including a communication link disposed on the musical related device, receiving control data from the communication link to control operation of the musical related device, and transmitting an audio signal from the musical related device through the communication link.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
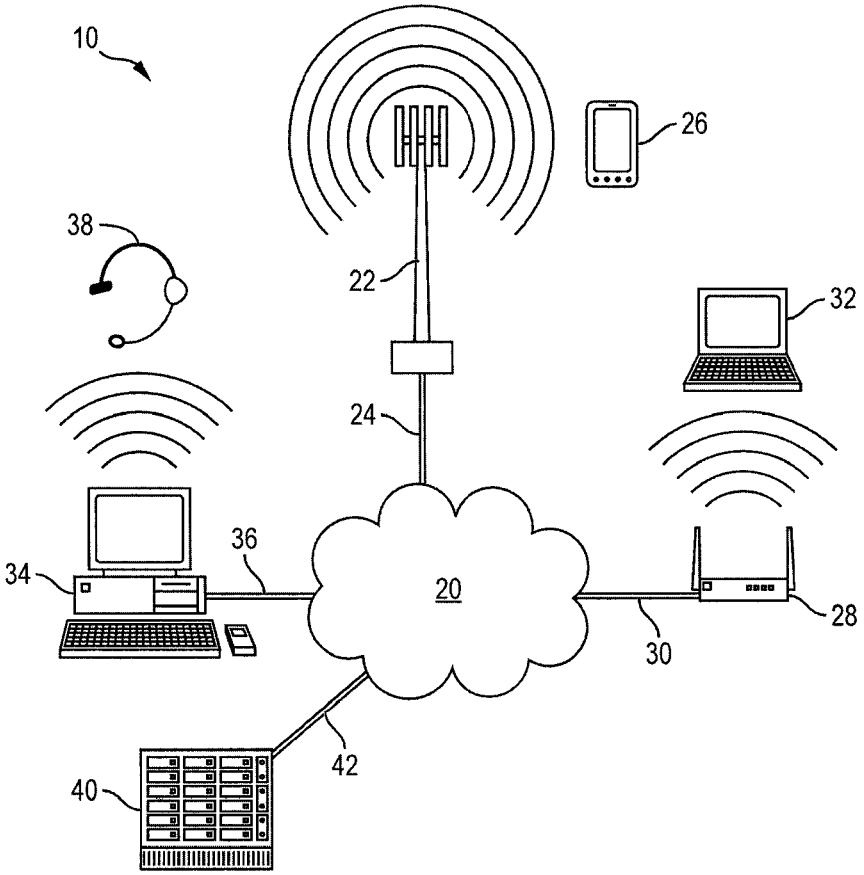
FIG. 1 illustrates electronic devices connected to a network through a communication system.

FIG. 1 shows devices and features of electronic system 10. Within electronic system 10, communication network 20 includes local area networks (LANs), wireless local area networks (WLANs), wide area networks (WANs), and the Internet for routing and transportation of data between various points in the network. The devices within communication network 20 are connected together through a communication infrastructure including a coaxial cable, twisted pair cable, Ethernet cable, fiber optic cable, RF link, microwave link, satellite link, telephone line, or other wired or wireless communication link. Communication network 20 is a distributed network of interconnected routers, gateways, switches, bridges, modems, domain name system (DNS) servers, dynamic host configuration protocol (DHCP) servers, each with a unique internet protocol (IP) address to enable communication between individual computers, cellular telephones, electronic devices, or nodes within the network. In one embodiment, communication network 20 is a global, open-architecture network, commonly known as the Internet. Communication network 20 provides services such as address resolution, routing, data transport, secure communications, virtual private networks (VPN), load balancing, and failover support.

Electronic system 10 further includes cellular base station 22 connected to communication network 20 through bi-directional communication link 24 in a hard-wired or wireless configuration. Communication link 24 includes a coaxial cable, Ethernet cable, twisted pair cable, telephone line, waveguide, microwave link, fiber optic cable, power line communication link, line-of-sight optical link, satellite link, or other wired or wireless communication link. Cellular base station 22 uses radio waves to communicate voice and data with cellular devices and provides wireless access to communication network 20 for authorized devices. The radio frequencies used by cellular base station 22 can include the 850 MHz, 900 MHz, 1700 MHz, 1800 MHz, 1900 MHz, 2000 MHz, and 2100 MHz bands. Cellular base station 22 employs one or more of the universal mobile telecommunication system (UMTS), high-speed downlink packet access (HSDPA), high-speed uplink packet access (HSUPA), evolved high-speed packet access (HSPA+), code division multiple access (CDMA), wideband CDMA (WCDMA), global system for mobile communications (GSM), GSM/EDGE, integrated digital enhanced network (iDEN), time division synchronous code division multiple access (TD-SCDMA), LTE, orthogonal frequency division multiplexing (OFDM), flash-OFDM, IEEE 802.16e (WiMAX), or other wireless communication protocols over 3G and 4G networks. Cellular base station 22 can include a cell tower. Alternatively, cellular base station can be a microcell, picocell, or femtocell, i.e., a smaller low-powered cellular base station designed to provide cellular service in limited areas such as a single building or residence.

Cellular device 26 includes cellular phones, smartphones, tablet computers, laptop computers, Wi-Fi hotspots, and other similar devices. The radio frequencies used by cellular device 26 can include the 850 MHz, 900 MHz, 1700 MHz, 1800 MHz, 1900 MHz, 2000 MHz, and 2100 MHz bands. Cellular device 26 employs one or more of the UMTS, HSDPA, HSUPA, HSPA+, CDMA, WCDMA, GSM, GSM/EDGE, iDEN, TD-SCDMA, LTE, WiMAX, OFDM, flash-OFDM, or other wireless communication protocols over 3G and 4G networks. Cellular device 26 communicates with cellular base station 22 over one or more of the frequency bands and wireless communication protocols supported by both the cellular device and the cellular base station. Cellular device 26 uses the connectivity provided by cellular base station 22 to perform tasks such as audio and/or video communications, electronic mail download and upload, short message service (SMS) messaging, browsing the world wide web, downloading software applications (apps), and downloading firmware and software updates, among other tasks. Cellular device 26 includes unique identifier information, typically an international mobile subscriber identity (IMSI) in a replaceable subscriber identity module (SIM) card, which determines which cellular base stations and services the cellular device can use.

Wireless access point (WAP) 28 is connected to communication network 20 through bi-directional communication link 30 in a hard-wired or wireless configuration. Communication link 30 includes a coaxial cable, Ethernet cable, twisted pair cable, telephone line, waveguide, microwave link, fiber optic cable, power line communication link, line-of-sight optical link, satellite link, or other wired or wireless communication link. Alternatively, communication link 30 can be a cellular radio link to cellular base station 22. WAP 28 uses radio waves to communicate data with wireless devices and provides wireless access to communication network 20 for authorized devices. Radio frequencies used by WAP 28 include the 2.4 GHz and 5.8 GHz bands. WAP 28 employs one or more of the IEEE 802.11a, IEEE 802.11b, IEEE 802.11g, IEEE 802.11n (collectively, Wi-Fi) protocols, or other wireless communication protocols. WAP 28 can also employ security protocols such as IEEE 802.11i, including Wi-Fi protected access (WPA) and Wi-Fi protected access II (WPA2), to enhance security and privacy.

WAP 28 and devices that connect to the WAP using the wireless communication protocols form an infrastructure-mode WLAN. WAP 28 includes a unique media access control (MAC) address that distinguishes WAP 28 from other devices. In one embodiment, WAP 28 is a laptop or desktop computer using a wireless network interface controller (WNIC) and software-enabled access point (SoftAP) software.

WAP 28 also includes a router, firewall, DHCP host, print server, and storage server. A router uses hardware and software to direct the transmission of communications between networks or parts of the network. A firewall includes hardware and software that determines whether selected types of network communication are allowed or blocked and whether communication with selected locations on a local or remote network are allowed or blocked. A DHCP host includes hardware and/or software that assigns IP addresses or similar locally-unique identifiers to devices connected to a network. A print server includes hardware and software that makes printing services available for use by devices on the network. A storage server includes hardware and software that makes persistent data storage such as a hard disk drive (HDD), solid state disk drive (SSD), optical drive, magneto-optical drive, tape drive, or USB flash drive available for use by devices on the network.

Wi-Fi device 32 includes laptop computers, desktop computers, tablet computers, server computers, smartphones, cameras, game consoles, televisions, and audio systems in mobile and fixed environments. Wi-Fi device 32 uses frequencies including the 2.4 GHz and 5.8 GHz bands, and employs one or more of the Wi-Fi or other wireless communication protocols. Wi-Fi device 32 employs security protocols such as WPA and WPA2 to enhance security and privacy. Wi-Fi device 32 uses the connectivity provided by WAP 28 to perform audio and video applications, download and upload data, browse the web, download apps, play music, and download firmware and software updates. Wi-Fi device 32 includes a unique MAC address that distinguishes Wi-Fi device 32 from other devices connected to WAP 28.

Personal area network (PAN) master device 34 includes desktop computers, laptop computers, audio systems, and smartphones. PAN master device 34 is connected to communication network 20 through bi-directional communication link 36 in a hard-wired or wireless configuration. Communication link 36 includes a coaxial cable, Ethernet cable, twisted pair cable, telephone line, waveguide, microwave link, fiber optic cable, power line communication link, line-of-sight optical link, satellite link, or other wired or wireless communication link. Alternatively, communication link 36 can be a cellular radio link to cellular base station 22 or a Wi-Fi link to WAP 28. PAN master device 34 uses radio waves to communicate with wireless devices. The radio frequencies used by PAN master device 34 can include the 868 MHZ, 915 MHz, 2.4 GHz, and 5.8 GHz bands or ultra wide band (UWB) frequencies, e.g. 9 GHz. PAN master device 34 employs one or more of the Bluetooth, zigbee, IEEE 802.15.3, ECMA-368, or similar PAN protocols, including the pairing, link management, service discovery, and security protocols.

PAN slave device 38 includes headsets, headphones, computer mice, computer keyboards, printers, remote controls, game controllers, and other such devices. PAN slave device 38 uses radio frequencies including the 868 MHZ, 915 MHz, 2.4 GHz, and 5.8 GHz bands or UWB frequencies and employs one or more of the bluetooth, zigbee, IEEE 802.15.3, ECMA-368, or similar PAN protocols, including the pairing, link management, service discovery, and security protocols. PAN slave device 38 uses the connectivity provided by PAN master device 34 to exchange commands and data with the PAN master device.

Computer server 40 connects to communication network 20 through bi-directional communication link 42 in a hard-wired or wireless configuration. Computer server 40 includes a plurality of mass storage devices or arrays, such as HDD, SSD, optical drives, magneto-optical drives, tape drives, or USB flash drives. Communication link 42 includes a coaxial cable, Ethernet cable, twisted pair cable, telephone line, waveguide, microwave link, fiber optic cable, power line communication link, line-of-sight optical link, satellite link, or other wired or wireless communication link. Server 40 provides file access, database, web access, mail, backup, print, proxy, and application services. File servers provide data read, write, and management capabilities to devices connected to communication network 20 using protocols such as the hypertext transmission protocol (HTTP), file transfer protocol (FTP), secure FTP (SFTP), network file system (NFS), common internet file system (CIES), apple filing protocol (AFP), andrew file system (AFS), iSCSI, and fibre channel over IP (FCIP). Database servers provide the ability to query and modify one or more databases hosted by the server to devices connected to communication network 20 using a language, such as structured query language (SQL). Web servers allow devices on communication network 20 to interact using HTTP with web content hosted by the server and implemented in languages, such as hypertext markup language (HTML), javascript, cascading style sheets (CSS), and PHP: hypertext preprocessor (PHP). Mail servers provide electronic mail send, receive, and routing services to devices connected to communication network 20 using protocols such as simple network mail protocol (SNMP), post office protocol 3 (POP3), internet message access protocol (IMAP), and messaging application programing interface (MAPI). Catalog servers provide devices connected to communication network 20 with the ability to search for information in other servers on communication network 20. Backup servers provide data backup and restore capabilities to devices connected to communication network 20. Print servers provide remote printing capabilities to devices connected to communication network 20. Proxy servers serve as intermediaries between other servers and devices connected to communication network 20 in order to provide security, anonymity, usage restrictions, bypassing of censorship, or other functions. Application servers provide devices connected to communication network 20 with the ability to execute on the server one or more applications provided on the server.

Figure 2:
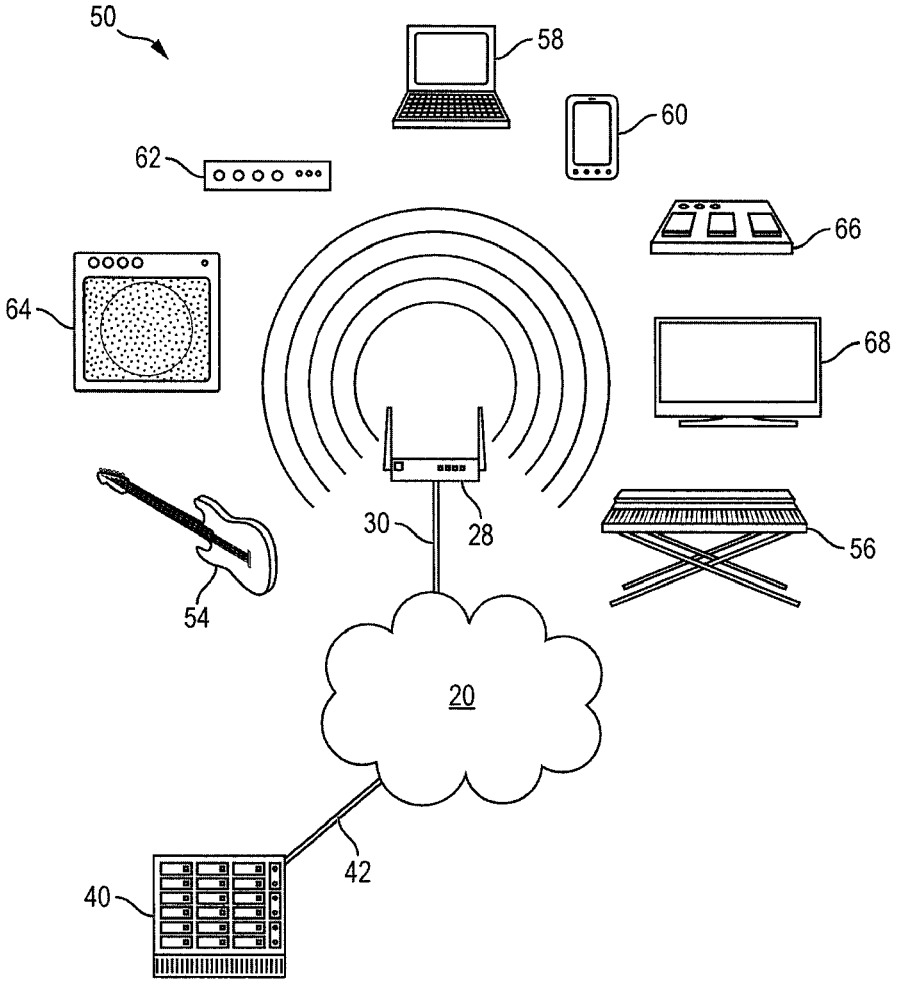
FIG. 2 illustrates musical instruments and musical related accessories connected to a wireless access point.

FIG. 2 shows an embodiment of electronic system 10 as wireless communication network 50 for connecting, configuring, monitoring, and controlling musical instruments and accessories within a musical system. In particular, wireless communication network 50 uses WAP 28 to send and receive analog or digital audio signals, control signals, and other data between musical instruments and musical related accessories, as well as other devices within electronic system 10, such as communication network 20 and server 40. WAP 28 is connected to communication network 20 by communication link 30. Communication network 20 is connected to server 40 by communication link 42. WAP 28 can also be connected to other devices within electronic system 10, including cellular device 26, Wi-Fi device 32, PAN master device 34, and PAN slave device 38.

In the present embodiment, WAP 28 communicates with musical instruments (MI) 54 and 56 depicted as an electric guitar and electric keyboard, respectively. Other musical instruments that can be connected to WAP 28 include a bass guitar, violin, horn, brass, drums, wind instrument, string instrument, piano, organ, percussions, and microphone. For MI that emit sound waves directly, a microphone or other sound transducer attached to or disposed in the vicinity of the MI converts the sound waves to electrical signals. WAP 28 further communicates with laptop computer 58, cell phone or mobile communication device 60, audio amplifier 62, speaker 64, effects pedal 66, and display monitor 68. Other electronic accessories can be connected to WAP 28, such as synthesizers, thermions, and samplers. MI 54-56 and accessories 58-68 each include an internal or external wireless transceiver or communication link and controller to send and receive analog or digital audio signals, control signals, and other data through WAP 28 between and among the devices, as well as communication network 20, cellular device 26, Wi-Fi device 32, PAN master device 34, PAN slave device 38, and server 40.

Consider an example where one or more users play a musical composition on MI 54 and MI 56. The configuration data of MI 54-56 corresponding to the musical composition is stored on laptop computer 58, mobile communication device 60, or internal memory of the MI. The configuration data for the musical composition is transmitted from laptop computer 58 or mobile communication device 60 through WAP 28 to MI 54-56. For MI 54, the configuration data selects one or more pickups on the guitar as the source of the audio signal, as well as the volume and tonal qualities of the audio signal transmitted to an output jack. For MI 56, the configuration data sets the volume, balance, sequencing, tempo, mixer, tone, effects, MIDI interface, and synthesizer. The configuration data of audio amplifier 62, speaker 64, and effects pedal 66 is also stored on laptop computer 58, mobile communication device 60, or internal memory of the accessory. The configuration data for the musical composition is transmitted from laptop computer 58 or mobile communication device 60 through WAP 28 to audio amplifier 62, speaker 64, and effects pedal 66, as well as other electronic accessories within wireless communication network 50. For audio amplifier 62, the configuration data sets the amplification, volume, gain, filtering, tone equalization, sound effects, bass, treble, midrange, reverb dwell, reverb mix, vibrato speed, and vibrato intensity. For speaker 64, the configuration data sets the volume and special effects. For effects pedal 66, the configuration data sets the one or more sound effects.

Once MI 54-56 and accessories 62-68 are configured, the user begins to play the musical composition. The audio signals generated from MI 54-56 are transmitted through WAP 28 to audio amplifier 62, which performs the signal processing of the audio signal according to the configuration data. The configuration of MI 54-56 and audio amplifier 62 can be updated at any time during the play of the musical composition. The configuration data is transmitted to devices 54-68 to change the signal processing of the audio signal in realtime. For example, the user can modify the signal processing function of audio amplifier 62 during play by pressing on effects pedal 66 to introduce a sound effect. The user operation on effects pedal 66 is transmitted through WAP 28 to audio amplifier 62, which implements on the user operated sound effects. The output signal of audio amplifier 62 is transmitted through WAP 28 to speaker 64. In some cases, speaker 64 handles the power necessary to reproduce the sound. In other cases, audio amplifier 62 can be connected to speaker 64 by audio cable to deliver the necessary power to reproduce the sound.

In general, any device 54-68 can communicate with any other device 54-68 through WAP 28. MI 54 can communicate with MI 56. MI 56 can communicate with effects pedal 66. Other electronic accessories, e.g. a synthesizer, can also be introduced into the signal processing audio amplifier 62. MI 54 can communicate with the synthesizer.

Figure 3:
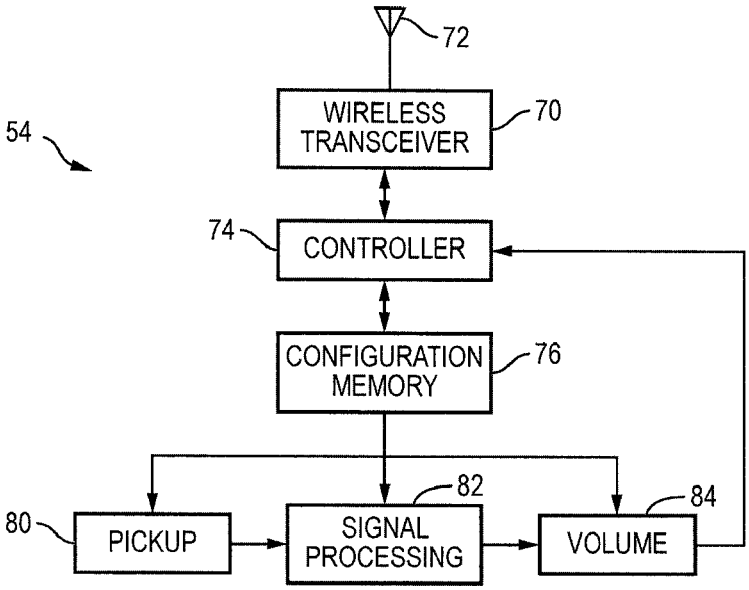
FIG. 3 illustrates a wireless interface to a musical instrument.

FIG. 3 illustrates further detail of MI 54 including internal or external wireless transceiver or communication link 70 for sending and receiving analog or digital audio signals, control signals, and other data from WAP 28 through antenna 72. Wireless transceiver 70 includes oscillators, modulators, demodulators, phased-locked loops, amplifiers, correlators, filters, baluns, digital signal processors, general-purpose processors, MAC, physical layer (PHY) devices, firmware, and software to implement a wireless data transmit and receive function. Wireless transceiver 70 can be disposed on the body of MI 54 or internal to the MI. Antenna 72 converts RF signals from wireless transceiver 70 into radio waves that propagate outward from the antenna and converts radio waves incident to the antenna into RF signals that are sent to the wireless transceiver. Antenna 72 includes one or more rigid or flexible external conductors, traces on a PC board, or conductive elements formed in or on a surface of MI 54.

Controller 74 controls routing of audio signals, control signals, and other data through MI 54. Controller 74 includes one or more processors, volatile memories, non-volatile memories, control logic and processing, interconnect busses, firmware, and software to implement the requisite control function. Volatile memory includes latches, registers, cache memories, static random access memory (SRAM), and dynamic random access memory (DRAM). Non-volatile memory includes read-only memory (ROM), programmable read-only memory (PROM), erasable programmable read-only memory (EPROM), electrically erasable programmable read-only memory (EEPROM), serial EPROM, magneto-resistive random-access memory (MRAM), ferro-electric RAM (F-RAM), phase-change RAM (PRAM), and flash memory. Control logic and processing includes programmable digital input and output ports, universal synchronous/asynchronous receiver/transmitter (USARTs), digital to analog converters (DAC), analog to digital converters (ADC), display controllers, keyboard controllers, universal serial bus (USB) controllers, I2C controllers, network interface controllers (NICs), and other network communication circuits. Controller 74 can also include signal processors, accelerators, or other specialized circuits for functions such as signal compression, filtering, noise reduction, and encryption. In one embodiment, controller 74 is implemented as a web server.

The control signals and other data are stored in configuration memory 76. The audio signals are generated by the user playing MI 54 and output from pickup 80. MI 54 may have multiple pickups 80, each with a different response to the string motion. The configuration data selects and enables one or more pickups 80 to convert string motion to the audio signals. Signal processing 82 and volume 84 modify digital and analog audio signals. The control signals and other data stored in configuration memory 76 set the operational state of pickup 80, signal processing 82, and volume 84. The audio output signal of volume 84 is routed to controller 74, which transmits the audio signals through wireless transceiver 70 and antenna 72 to WAP 28. The audio signals continue to the next musical related accessory, e.g. audio amplifier 62 or other accessory 58-68.

Figure 4:
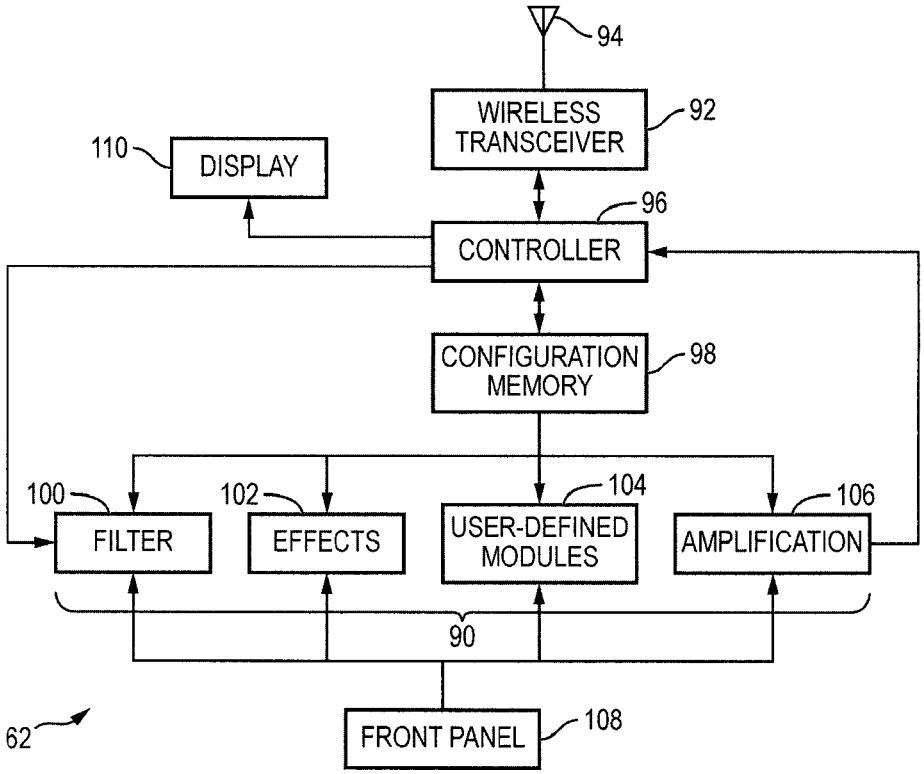
FIG. 4 illustrates a wireless interface to an audio amplifier.

FIG. 4 illustrates further detail of audio amplifier 62 including signal processing section 90 and internal or external wireless transceiver or communication link 92. Wireless transceiver 92 sends and receives analog or digital audio signals, control signals, and other data from WAP 28 through antenna 94. The audio signals, control signals, and other data may come from MI 54-56 and accessories 58-68. Controller 96 controls routing of audio signals, control signals, and other data through audio amplifier 62, similar to controller 74. In one embodiment, controller 76 is implemented as a web server. The control signals and other data are stored in configuration memory 98. The audio signals are routed through filter 100, effects 102, user-defined modules 104, and amplification block 106 of signal processing section 90. Filter 100 provides various filtering functions, such as low-pass filtering, bandpass filtering, and tone equalization functions over various frequency ranges to boost or attenuate the levels of specific frequencies without affecting neighboring frequencies, such as bass frequency adjustment and treble frequency adjustment. For example, the tone equalization may employ shelving equalization to boost or attenuate all frequencies above or below a target or fundamental frequency, bell equalization to boost or attenuate a narrow range of frequencies around a target or fundamental frequency, graphic equalization, or parametric equalization. Effects 102 introduce sound effects into the audio signal, such as reverb, delays, chorus, wah, auto-volume, phase shifter, hum canceller, noise gate, vibrato, pitch-shifting, tremolo, and dynamic compression. User-defined modules 104 allows the user to define customized signal processing functions, such as adding accompanying instruments, vocals, and synthesizer options. Amplification block 106 provides power amplification or attenuation of the audio signal. Other signal processing blocks can be used depending on the nature of the analog or digital audio signal.

The control signals and other data stored in configuration memory 98 set the operational state of filter 100, effects 102, user-defined modules 104, and amplification block 106. In one embodiment, the configuration data sets the operational state of various electronic amplifiers, DAC, ADC, multiplexers, memory, and registers to control the signal processing within audio amplifier 62. Controller 96 may set the operational value or state of a control servomotor-controlled potentiometer, servomotor-controlled variable capacitor, amplifier with electronically controlled gain, or an electronically-controlled variable resistor, capacitor, or inductor. Controller 96 may set the operational value or state of a stepper motor or ultrasonic motor mechanically coupled to and capable of rotating a volume, tone, or effect control knob, electronically-programmable power supply adapted to provide a bias voltage to tubes, or mechanical or solid-state relay controlling the flow of power to audio amplifier 62. Alternatively, the operational state of filter 100, effects 102, user-defined modules 104, and amplification block 106 can be set manually through front panel 108.

Each note or chord played on MI 54 and 56 is processed through audio amplifier 62, as configured by controller 96 and stored in configuration memory 98, to generate an audio output signal of signal processing section 90. The audio output signal of signal processing section 90 is routed to controller 96, which transmits the post signal processing audio signals through wireless transceiver 92 and antenna 94 to WAP 28 using the WPS, Wi-Fi Direct, or another wireless setup protocol. The post signal processing audio signals continue to the next musical related accessory, e.g. speaker 64 or other accessory 58-68.

Display 110 shows the present state of controller 96 and configuration memory 98 with the operational state of signal processing section 90. Controller 96 can also read the present state of configuration memory 98 with the operational state of signal processing section 90 for transmission through wireless transceiver 92 and antenna 94 to WAP 28.

Figure 5:
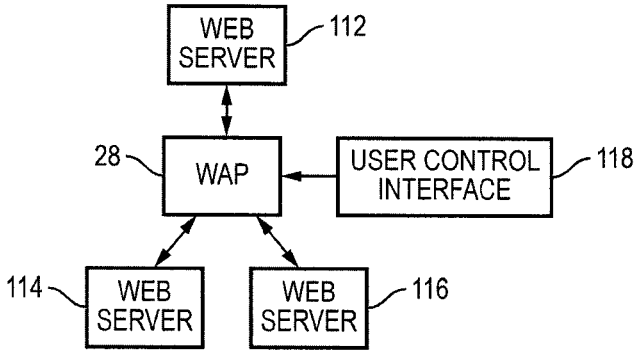
FIG. 5 illustrates a plurality of web servers connected to a wireless access point.

FIG. 5 illustrates a general view of the interconnection between wireless devices 54-68. Web servers 112, 114, and 116 each denote user configured functionality within devices 54-68, i.e., each device 54-68 includes a web server interface, such as a web browser, for configuring and controlling the transmission, reception, and processing of analog or digital audio signals, control signals, and other data through WAP 28 and over wireless communication network 50 or electronic system 10. The web browser interface provides for user selection and viewing of the control data in human perceivable form. For example, MI 54 includes web server 112 implemented through user configuration of wireless transceiver 70, controller 74, and configuration memory 76; audio amplifier 62 includes web server 114 implemented through user configuration of wireless transceiver 92, controller 96, and configuration memory 98; and speaker 64 includes web server 116.

Web servers 112-116 are configured by user control interface 118, see FIGS. **6*a*-6*e*, and communicate with each other through WAP 28 over wireless communication network 50 or electronic system 10. User control interface 118 can be implemented using a web browser with laptop computer 58 or mobile communication device 60 to provide a human interface to web servers 112-116**, e.g. using a keypad, keyboard, mouse, trackball, joystick, touchpad, touchscreen, and voice recognition system connected to a serial port, USB, MIDI, bluetooth, zigBee, Wi-Fi, or infrared connection of the user control interface.

Web servers 112-116 are configured through user control interface 118 so that each device can share data between MI 54-56, related accessories 58-68, PAN master device 34, and server 40 through communication network 20. The shared data includes presets, files, media, notation, playlists, device firmware upgrades, device configuration data, and audio signals. Any device 54-68 can communicate with any other device 54-68 through WAP 28. Musical performances conducted with MI 54-56 and related accessories 58-68 can be stored on PAN master device 34, laptop computer 58, mobile communication device 60, and server 40. Streaming audio and streaming video can be downloaded from PAN master device 34, laptop computer 58, mobile communication device 60, and server 40 through communication network 20 and executed on MI 54-56 and related accessories 58-68. The streaming audio and streaming video is useful for live and pre-recorded performances, lessons, virtual performance, and social jam sessions, which can be presented on display monitor 68.

FIG. **6*a* illustrates web browser based interface for user control interface 118 as displayed on laptop computer 58 or mobile communication device 60. Home webpage 120 illustrates the user selectable configuration data for communication network 50. The webpages can be written in HTML, Javascript, CSS, PHP, Java, or flash and linked together with hyperlinks, Javascript, or PHP commands to provide a graphical user interface (GUI) containing JPEG, GIF, PNF, BMP or other images. Home webpage 120 can be local to laptop computer 58 or mobile communication device 60 or downloaded from server 40 and formatted or adapted to the displaying device. Home webpage 120 can be standardized with common features for devices 54-68. For example, the identifier or designation of each device 54-68 in block 122 and network status in block 124 can use a standard format. User control interface 118 can poll and identify devices 54-68 presently connected to WAP 28 in block 126. The wireless interconnect protocol is displayed in block 128. The presently executing commands and status of other devices within wireless communication network 50 are displayed in block 130. The user can select configuration of individual devices 54-68 in wireless communication network 50 in block 132**.

Figure 6A:
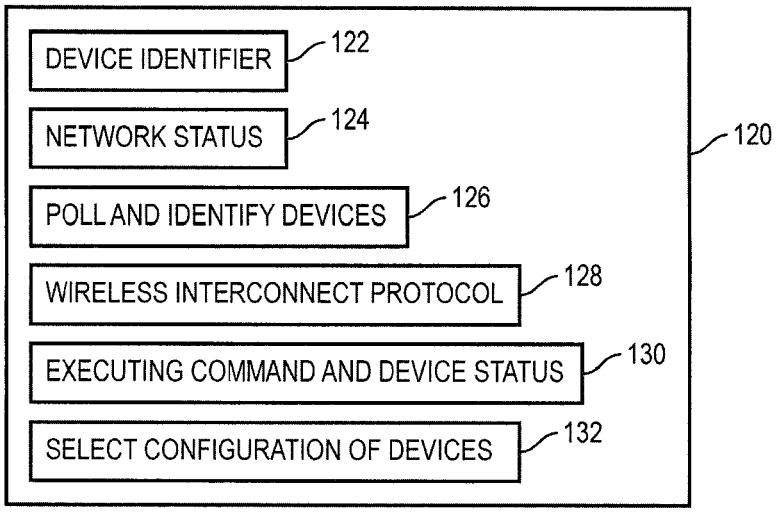
FIGS. 6*a*-6*e* illustrate webpages for monitoring and configuring a musical instrument or musical related accessory.
Figure 6B:
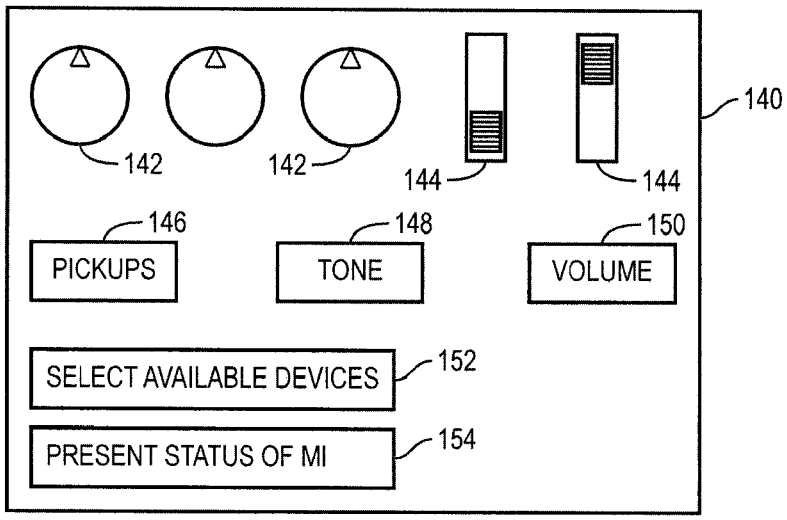

FIG. 6*b* illustrates a configuration webpage 140 within the web browser for MI 54 selected by block 132. Webpage 140 allows configuration of virtual rotary knobs 142, control switches 144, pickups in block 146, volume control in block 148, tone control in block 150, and drop down menu 152 to select from available devices as the destination for the audio signal from MI 54. Webpage 140 also displays the present status of MI 54 in block 154, e.g. musical composition being played and present configuration of MI 54. Additional webpages within the web browser can present more detailed information and selection options for each configurable parameter of MI 54. Webpage 140 can present information in GUI format that mimics the appearance of knobs and switches available on the exterior of MI 54, communicating the value of each parameter controlled by a knob or switch with a visual representation similar to the actual appearance of the corresponding knob or switch and allowing the parameter to be altered through virtual manipulation of the visual representation on the webpage. Webpage 140 allows the creation, storage, and loading of a plurality of custom configurations for MI 54.

In one embodiment, the user can control pickup 80, signal processing 82, and volume 84 using virtual knobs 142 and control switches 144 through web server 112 interface to user control interface 118. Turning virtual knobs 142 and changing the position of control switches 144 through the web server interface changes the settings of pickup 80, signal processing 82, and volume 84 on MI 54. Likewise, turning the knobs and changing the position of control switches on MI 54 changes the appearance of virtual knobs 142 and control switches 144 on webpage 140. The wireless communication through WAP 28 links MI 54 to user control interface 118, as well as other devices 56-68.

Figure 6C:
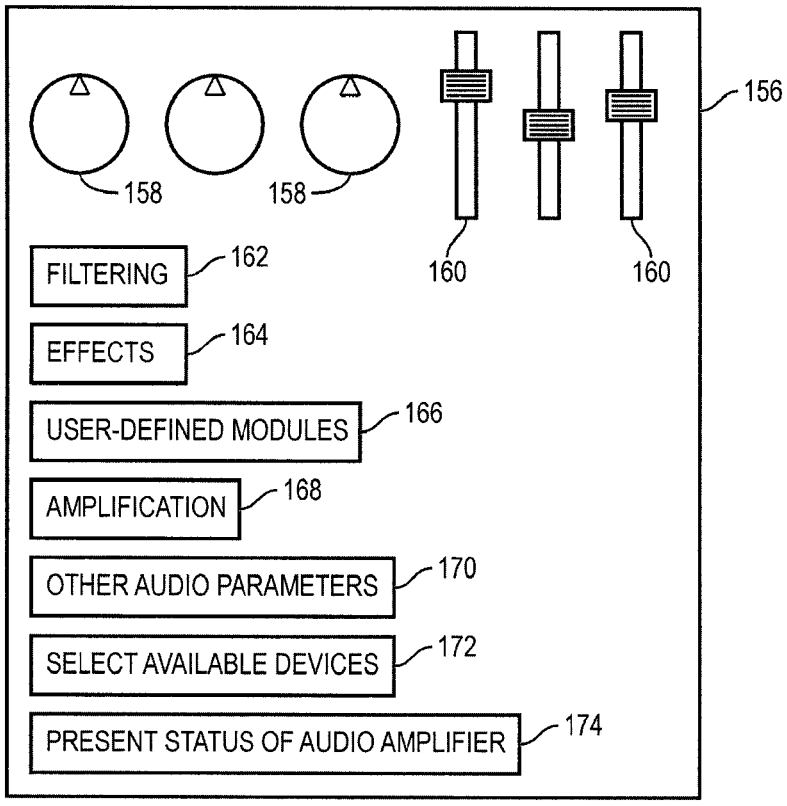

FIG. 6*c* illustrates a configuration webpage 156 within the web browser for audio amplifier 62 selected by block 132. Webpage 156 allows the user to monitor and configure virtual knobs 158, slide controls 160, filtering in block 162, effects in block 164, user-defined modules in block 166, amplification control in block 168, other audio parameter in block 170, and select from available devices as the destination for the post signal processing audio signal from audio amplifier 62 in drop down menu 172. Webpage 156 also displays the present status of audio amplifier 62 in block 174, e.g. musical composition being played and present configuration of filter 100, effects 102, user-defined modules 104, and amplification block 106. Additional webpages within the web browser can present more detailed information and selection options for each configurable parameter of audio amplifier 62. For example, the additional webpages can monitor and maintain the working condition of audio amplifier 62, track hours of operation of tubes within the amplifier, monitoring and allowing adjustment of the bias voltage of tubes within the amplifier, and monitoring temperatures within the amplifier. Webpage 156 can present information in GUI format that mimics the appearance of the knobs and switches available on the exterior of audio amplifier 62, communicating the value of each parameter controlled by a knob or switch with a visual representation similar to the actual appearance of the corresponding knob or switch and allowing the parameter to be altered through virtual manipulation of the visual representation on the webpage. Webpage 156 allows the creation, storage, and loading of a plurality of custom configurations for audio amplifier 62.

In one embodiment, the user can control filter 100, effects 102, user-defined modules 104, and amplification block 106 within audio amplifier 62 using virtual knobs 158 and slide controls 160 through web server 114 interface to user control interface 118. Turning virtual knobs 158 and changing the position of slide controls 160 through the web server interface changes the settings of filter 100, effects 102, user-defined modules 104, and amplification block 106 on audio amplifier 62. Likewise, turning the knobs and changing the position of control switches on audio amplifier 62 changes the appearance of virtual knobs 158 and slide controls 160 on webpage 156. The wireless communication through WAP 28 links audio amplifier 62 to user control interface 118, as well as other devices 54-68.

Figure 6D:
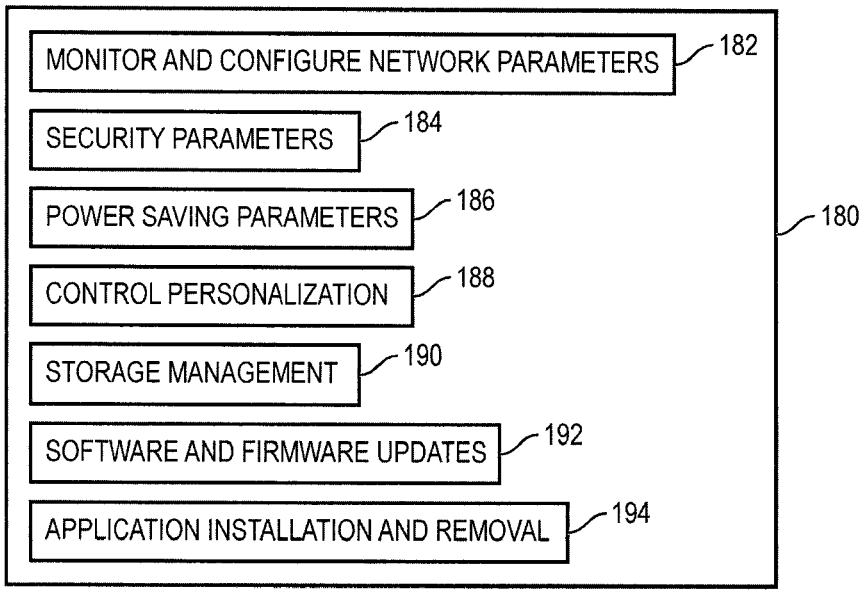

FIG. 6*d* illustrates a configuration webpage 180 for WAP 28 selected by block 132. Webpage 180 allows the user to monitor and configure network parameters in block 182, security parameters in block 184, power saving parameters in block 186, control personalization in block 188, storage management in block 190, software and firmware updates in block 192, and application installation and removal in block 194.

Figure 6E:
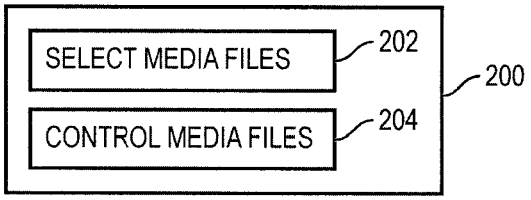

FIG. 6*e* illustrates a configuration webpage 200 for media services selected by block 132. Webpage 200 allows the user to monitor and select one or more media files stored within laptop computer 58, mobile communication device 60, or server 40 in block 202. Media files include WAV, MP3, WMA, and MIDI files including media files suitable for use as accompaniment for a performance, such as a drum track, background track, bassline, or intermission program. Webpage 200 includes controls to adjust the volume, pitch, and tempo of the media files in block 204. Webpage 200 can configure a media file to begin play at a set time after audio amplifier 62 is taken off standby, upon receiving a command from an external device, or when WAP 28 detects an audio signal from a musical instrument or microphone connected to audio amplifier 62. Webpage 200 can select the media files for mixing with other audio signals received by audio amplifier 62 and can play the resulting mix through the amplifier.

Figure 7:
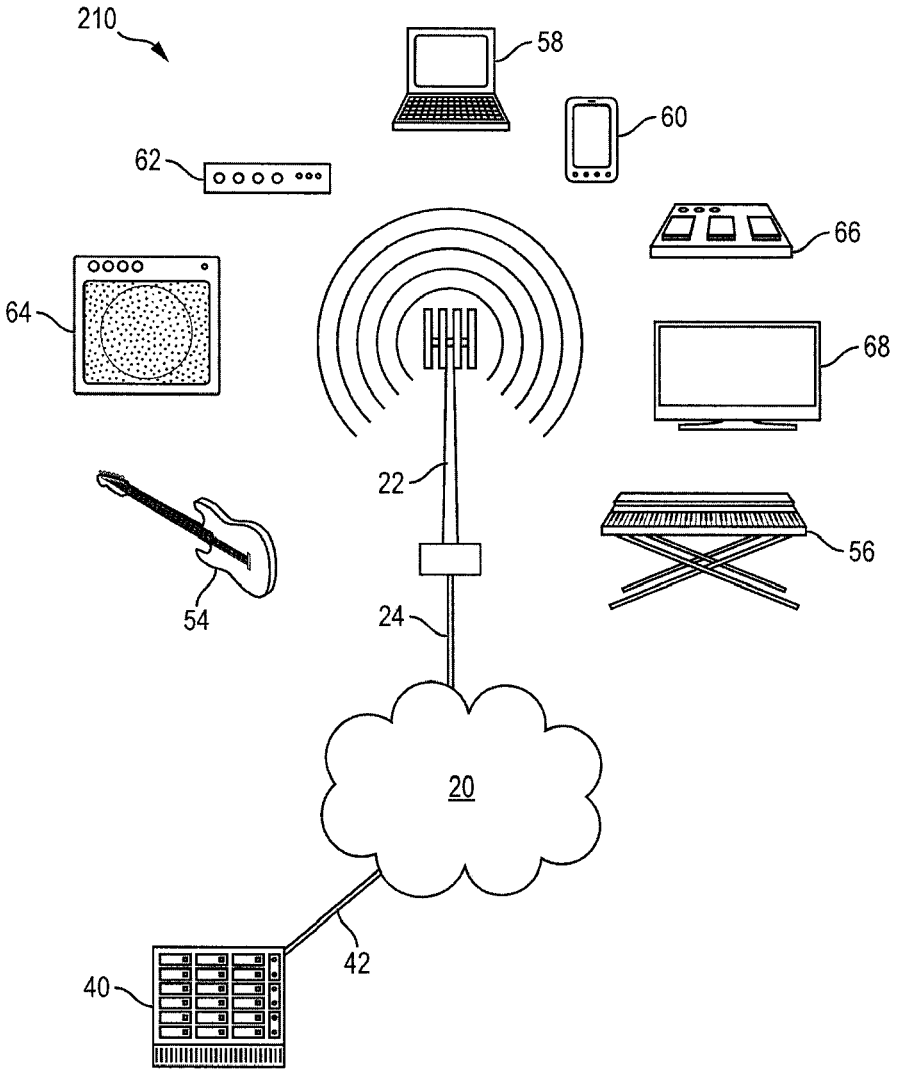
FIG. 7 illustrates musical instruments and musical related accessories connected to a cellular base station.

FIG. 7 illustrates wireless communication network 210 for connecting, configuring, monitoring, and controlling musical instruments and accessories within the musical system. In particular, wireless communication network 210 uses cellular base station 22 or cellular mobile Wi-Fi hotspot to send analog or digital audio signals, control signals, and other data using 3G and 4G wireless communication channels between musical instruments and accessories, as well as other devices within electronic system 10, such as communication network 20 and server 40. A cellular mobile Wi-Fi hotspot includes smartphones, tablet computers, laptop computers, desktop computers, stand-alone hotspots, MiFi, and similar devices connected to communication network 20 through cellular base station 22. Cellular base station 22 is connected to communication network 20 by communication link 24. Communication network 20 is connected to server 40 by communication link 42. Cellular base station 22 can also be connected to other devices within electronic system 10, including cellular device 26, Wi-Fi device 32, PAN master device 34, and PAN slave device 38.

In the present embodiment, cellular base station 22 communicates with MI 54 and MI 56, as well as other musical instruments such as a violin, horn, brass, drums, wind instrument, string instrument, piano, organ, percussions, and microphone. Cellular base station 22 further communicates with laptop computer 58, mobile communication device 60, audio amplifier 62, speaker 64, and effects pedal 66. Other electronic accessories can be connected to cellular base station 22, such as synthesizers, thermions, and samplers. MI 54-56 and accessories 58-68 each include an internal or external wireless transceiver unit to send and receive audio signals, control signals, and other data through cellular base station 22 between and among the devices, as well as network 20, cellular device 26, Wi-Fi device 32, PAN master device 34, PAN slave device 38, and server 40. Accordingly, any device 54-68 can communicate with any other device 54-68 through cellular base station 22.

Consider an example where one or more users play a musical composition on MI 54 and MI 56. The configuration data of MI 54-56 is stored on laptop computer 58, mobile communication device 60, or internal memory of the MI. The configuration data for the musical composition is transmitted from laptop computer 58 or mobile communication device 60 through cellular base station 22 to MI 54-56. For MI 54, the configuration data selects one or more pickups on the guitar as the source of the audio signal, as well as the volume and tonal qualities of the audio signal transmitted to an output jack. For MI 56, the configuration data sets the volume, balance, sequencing, tempo, mixer, tone, effects, MIDI interface, and synthesizer. The configuration data of audio amplifier 62, speaker 64, and effects pedal 66 is also stored on laptop computer 58, mobile communication device 60, or internal memory of the accessory. The configuration data for the musical composition is transmitted from laptop computer 58 or mobile communication device 60 through cellular base station 22 to audio amplifier 62, speaker 64, and effects pedal 66, as well as other electronic accessories within communication network 210. For audio amplifier 62, the configuration data sets the amplification, volume, gain, filtering, tone equalization, sound effects, bass, treble, midrange, reverb dwell, reverb mix, vibrato speed, and vibrato intensity. For speaker 64, the configuration data sets the volume and special effects. For effects pedal 66, the configuration data sets the one or more sound effects.

Once MI 54-56 and accessories 62-68 are configured, the user begins to play the musical composition. The audio signals generated from MI 54-56 are transmitted through cellular base station 22 to audio amplifier 62, which performs the signal processing according to the configuration data. The configuration of MI 54-56 and audio amplifier 62 can be updated at any time during the play of the musical composition according the configuration data set by user control interface 118. The configuration data is transmitted to devices 54-68 to change the signal processing of the audio signal in realtime. The user can modify the signal processing function during play by pressing on effects pedal 66 to introduce a sound effect. The user operation on effects pedal 66 is transmitted through cellular base station 22 to audio amplifier 62, which implements on the user operated sound effects. Other electronic accessories, e.g. a synthesizer, can also be introduced into the signal processing audio amplifier 62 through cellular base station 22. The output signal of audio amplifier 62 is transmitted through cellular base station 22 to speaker 64.

In general, any device 54-68 can communicate with any other device 54-68 through cellular base station 22. MI 54 can communicate with MI 56. MI 56 can communicate with effects pedal 66. Other electronic accessories, e.g. a synthesizer, can also be introduced into the signal processing audio amplifier 62. MI 54 can communicate with the synthesizer.

Figure 8:
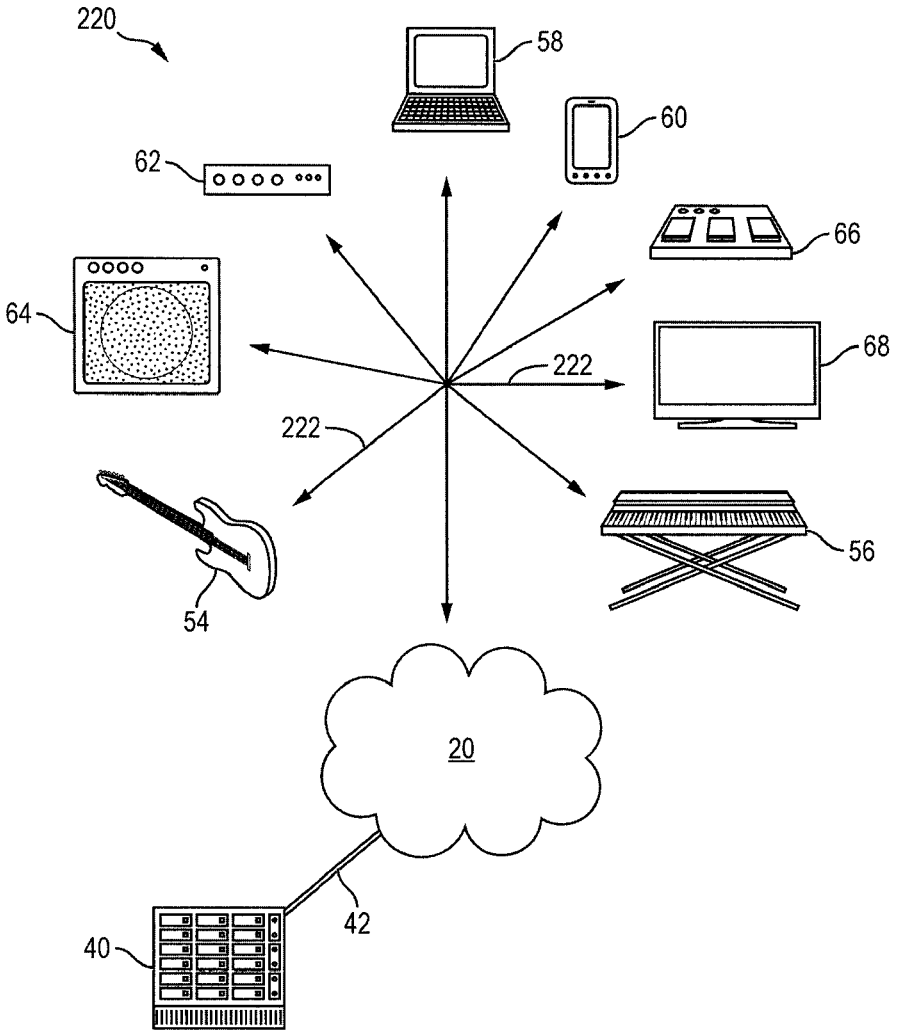
FIG. 8 illustrates musical instruments and musical related accessories connected through an adhoc network.

FIG. 8 illustrates an adhoc communication network 220 for connecting, configuring, monitoring, and controlling musical instruments and accessories within the musical system. In particular, communication network 220 uses wired and wireless direct communication links 222 to send and receive analog or digital audio signals, control signals, and other data between musical instruments and accessories, as well as other devices within electronic system 10, such as communication network 20 and server 40. Each device 54-68 polls, identifies, and connects to any other device within the network through communication links 222. For example, MI 54 polls, identifies, and connects to audio amplifier 62 through communication links 222; MI 54 polls, identifies, and connects to effects pedal 66 through communication links 222; audio amplifier 62 polls, identifies, and connects to speaker 64 through communication links 222; mobile communication device 60 polls, identifies, and connects to MI 56 through communication links 222; laptop computer 58 polls, identifies, and connects to server 40 through communication links 222. Any device 54-68 can communicate with any other device 54-68 through communication links 222 within communication network 220.

Consider an example where one or more users play a musical composition on MI 54 and MI 56. The configuration data of MI 54-56 is stored on laptop computer 58, mobile communication device 60, or internal memory of the MI. The configuration data for the musical composition is transmitted from laptop computer 58 or mobile communication device 60 through communication links 222 to MI 54-56. For MI 54, the configuration data selects one or more pickups on the guitar as the source of the audio signal, as well as the volume and tonal qualities of the audio signal transmitted to an output jack. For MI 56, the configuration data sets the volume, balance, sequencing, tempo, mixer, tone, effects, MIDI interface, and synthesizer. The configuration data of audio amplifier 62, speaker 64, and effects pedal 66 is also stored on laptop computer 58, mobile communication device 60, or internal memory of the accessory. The configuration data for the musical composition is transmitted from laptop computer 58 or mobile communication device 60 through communication links 222 to audio amplifier 62, speaker 64, and effects pedal 66, as well as other electronic accessories within communication network 220. For audio amplifier 62, the configuration data sets the amplification, volume, gain, filtering, tone equalization, sound effects, bass, treble, midrange, reverb dwell, reverb mix, vibrato speed, and vibrato intensity. For speaker 64, the configuration data sets the volume and special effects. For effects pedal 66, the configuration data sets the one or more sound effects.

Once MI 54-56 and accessories 62-68 are configured, the user begins to play the musical composition. The audio signals generated from MI 54-56 are transmitted through communication links 222 to audio amplifier 62, which performs the signal processing according to the configuration data. The configuration of MI 54-56 and audio amplifier 62 can be updated at any time during the play of the musical composition according the configuration data set by user control interface 118. The configuration data is transmitted to devices 54-68 to change the signal processing of the audio signal in realtime. The user can modify the signal processing function during play by pressing on effects pedal 66 to introduce a sound effect. The user operation on effects pedal 66 is transmitted through communication links 222 to audio amplifier 62, which implements on the user operated sound effects. Other electronic accessories, e.g. a synthesizer, can also be introduced into the signal processing audio amplifier 62 through communication links 222. The output signal of audio amplifier 62 is transmitted through communication links 222 to speaker 64.

In general, any device 54-68 can communicate with any other device 54-68 through communication links 222. MI 54 can communicate with MI 56. MI 56 can communicate with effects pedal 66. Other electronic accessories, e.g. a synthesizer, can also be introduced into the signal processing audio amplifier 62. MI 54 can communicate with the synthesizer.

Figure 9:
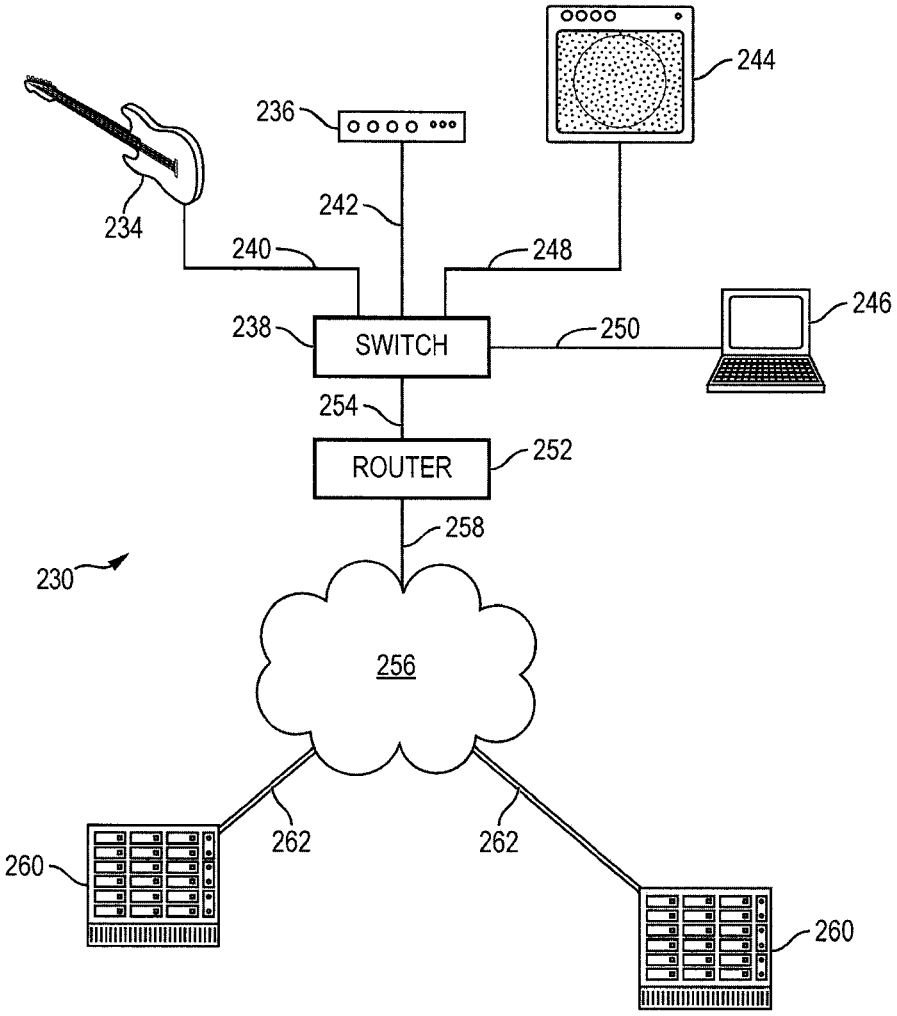
FIG. 9 illustrates musical instruments and musical related accessories connected through a wired communication network.

FIG. 9 shows wired communication network 230 for connecting, configuring, monitoring, and controlling musical instruments and musical related accessories within the system. In particular, communication network 230 uses an IEEE 802.3 standard, i.e. Ethernet protocol, with requisite network interface cards, cabling, switches, bridges, and routers for communication between devices. In particular, MI 234 and audio amplifier 236 are connected to switch or access point 238 with Ethernet cabling 240 and 242, respectively. Speaker 244 and laptop computer 246 are also connected to switch 238 through Ethernet cabling 248 and 250. Switch 238 is connected to router 252 by Ethernet cabling 254, which in turn is connected to communication network 256 by communication link 258. Communication network 256 is connected to cloud servers 260 by communication links 262, similar to server 40.

In the present embodiment, MI 234 depicted as an electric guitar communicates audio amplifier 236 through cabling 240 and 242 and switch 238. Audio amplifier 236 communicates with speaker 244 and laptop computer 246 through cabling 248 and 250 and switch 238. MI 234, audio amplifier 236, and speaker 244 can be configured through switch 238 with data from laptop computer 246. Accordingly, any device 234-244 can communicate with any other device 234-244 through switch 238. The configuration data for the musical composition is transmitted from laptop computer 246 through switch 238 to MI 234. The configuration data selects one or more pickups on the guitar as the source of the audio signal, as well as the volume and tonal qualities of the audio signal transmitted to an output jack. The configuration data of audio amplifier 236 and speaker 244 is also stored on laptop computer 58 or internal memory of the accessory. The configuration data for the musical composition is transmitted from laptop computer 246 through switch 238 to audio amplifier 236 and speaker 244, as well as other electronic accessories within communication network 230. For audio amplifier 236, the configuration data sets the amplification, volume, gain, filtering, tone equalization, sound effects, bass, treble, midrange, reverb dwell, reverb mix, vibrato speed, and vibrato intensity. For speaker 244, the configuration data sets the volume and special effects.

Once MI 234 and accessories 236 and 244 are configured, the user begins to play the musical composition. The audio signals generated from MI 234 are transmitted through switch 238 to audio amplifier 236, which performs the signal processing of the audio signal according to the configuration data. The configuration of MI 234 and audio amplifier 236 can be updated at any time during the play of the musical composition according the configuration data set by user control interface 118. The configuration data is transmitted to devices 234, 236, and 244 to change the signal processing of the audio signal in realtime. The output signal of audio amplifier 236 is transmitted through switch 238 to speaker 244. In some cases, speaker 244 handles the power necessary to reproduce the sound. In other cases, audio amplifier 236 can be connected to speaker 244 by audio cable to deliver the necessary power to reproduce the sound.

In addition, the analog or digital audio signals, control signals, and other data from MI 234 and musical related accessories 236 and 244 are transmitted through switch 238 and stored on laptop 246 or servers 260 as a recording of the play of the musical composition. The destination of the audio signals is selected with laptop computer 246. For example, the user selects the destination of the recording as cloud servers 260. As the user plays the musical composition, the audio signals, control signals, and other data from MI 234 and accessories 236 and 244 are transmitted through switch 238 in realtime and stored on servers 260. The audio signals, control signals, and other data can be formatted as MIDI data and stored on servers 260. The recording stored on cloud server 260 is available for later access by the user or other person authorized to access the recording.

Figure 10:
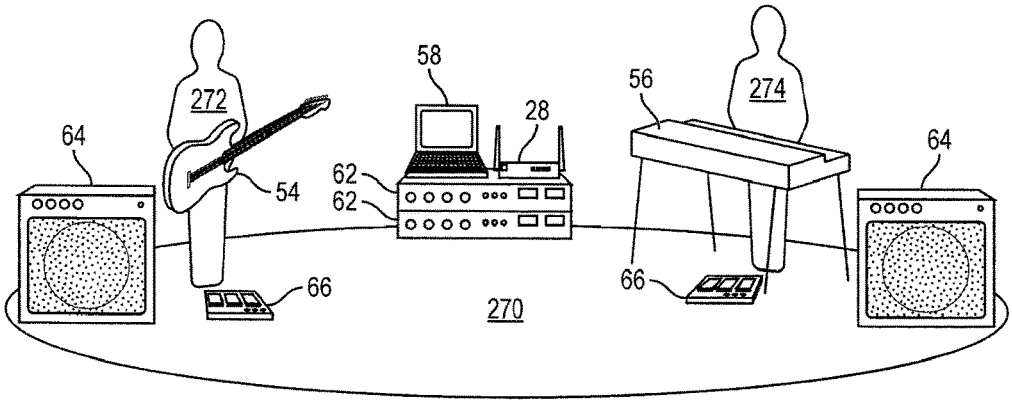
FIG. 10 illustrates a stage for arranging musical instruments and musical related accessories connected through a wireless access point.

Consider an example of setting up and performing one or more musical compositions in a wireless configuration on stage 270 in FIG. 10. Continuing with the wireless network configuration of FIG. 2, MI 54-56 are made available on stage 270 to users 272 and 274. Audio amplifiers 62 and speakers 64 are positioned on stage 270. Effects pedals 66 are placed near the feet of users 272-274. WAP 28 and laptop computer 58 are placed in the vicinity of stage 270. Note that there is no physical cabling to connect MI 54-56, audio amplifiers 62, speakers 64, and effects pedals 66. Devices 54-68 are detected through WAP 28 and wirelessly connected and synced through web servers 112-116 using zeroconf, universal plug and play (UPnP) protocols, Wi-Fi direct, or NFC communications. Users 272-274 select, for a given musical composition, configuration data for each of devices 54-68 using webpages 120, 140, 156, 180, and 200 on laptop computer 58. The configuration data is transmitted wirelessly from laptop computer 58 through WAP 28 to the web server interface of devices 54-68. The control features of MI 54-56, e.g. select pickup, volume, tone, balance, sequencing, tempo, mixer, effects, and MIDI interface, are set in accordance with the musical composition. The control features of audio amplifiers 62, speakers 64, and effects pedals 66 are set in accordance with the musical composition.

Users 272-274 begin to play MI 54-56. The audio signals generated by MI 54-56 are transmitted through WAP 28 to audio amplifiers 62, speakers 64, and effects pedals 66 to wirelessly interconnect, control, modify, and reproduce the audible sounds. The musical composition is played without the use of physical cabling between devices 54-68. The configuration data can be continuously updated in devices 54-68 during the performance according to the emphasis or nature of the musical composition as set by user control interface 118. The configuration data is transmitted to devices 54-68 to change the signal processing of the audio signal in realtime. For example, at the appropriate time, the active pickup on MI 54 can be changed, volume can be adjusted, different effects can be activated, and the synthesizer can be engaged. The configuration of devices 54-68 can be changed for the next musical composition. Users 272-274 can stop the performance, e.g. during a practice session, and modify the configuration data via webpages 120, 140, 156, 180, and 200 on laptop computer 58 to optimize or enhance the presentation of the performance. Musical instruments or related accessories not needed for a particular composition can be disabled or taken off-line through WAP 28. Musical instruments or related accessories no longer needed can be readily removed from stage 270 to reduce clutter and make space. WAP 28 detects the absence of one or more devices 54-68 and user control interface 118 removes the devices from the network configuration. Other musical instruments or related accessories can be added to stage 270 for the next composition. The additional devices are detected and configured automatically through WAP 28. The performance can be recorded and stored on server 40 or any other mass storage device in the network through communication network 50. At the end of the performance, users 272-274 simply remove devices 54-68 from stage 270, again without disconnecting and storing any physical cabling.

Figure 11:
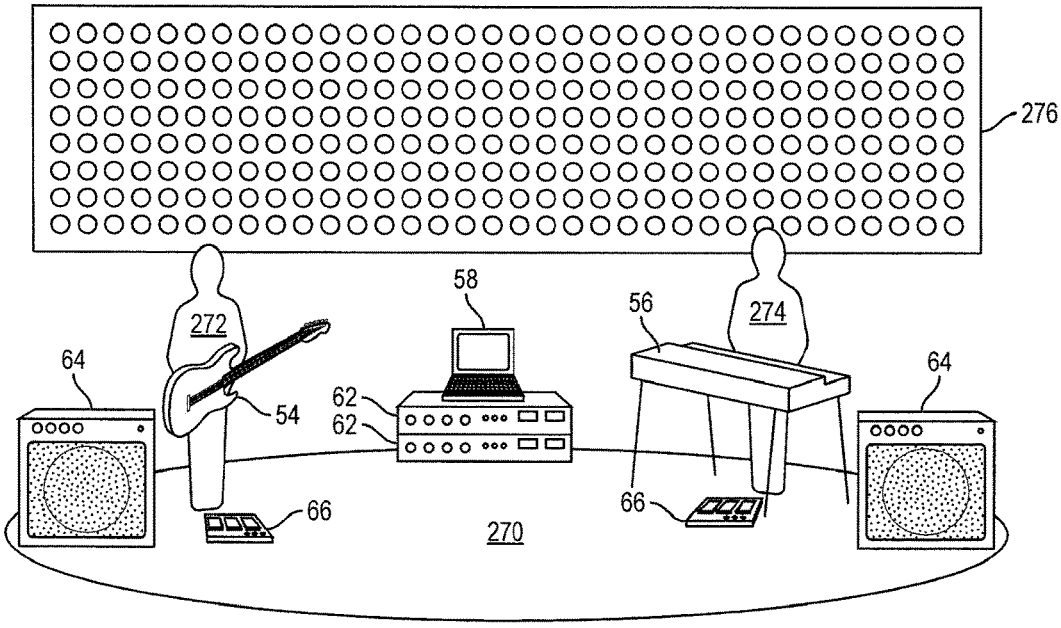
FIG. 11 illustrates a stage with special effects for arranging musical instruments and musical related accessories connected through a communication link.

FIG. 11 illustrates setting up and performing one or more musical compositions in an adhoc communication configuration on stage 270, similar to FIG. 8, including control of special effects during a musical performance. The configuration data from laptop computer 58 or mobile communication device 60 can be transmitted by communication links 222 to control lighting, lasers, props, pyrotechnics, fog, and other visual and audible special effects 276.

Figure 12:
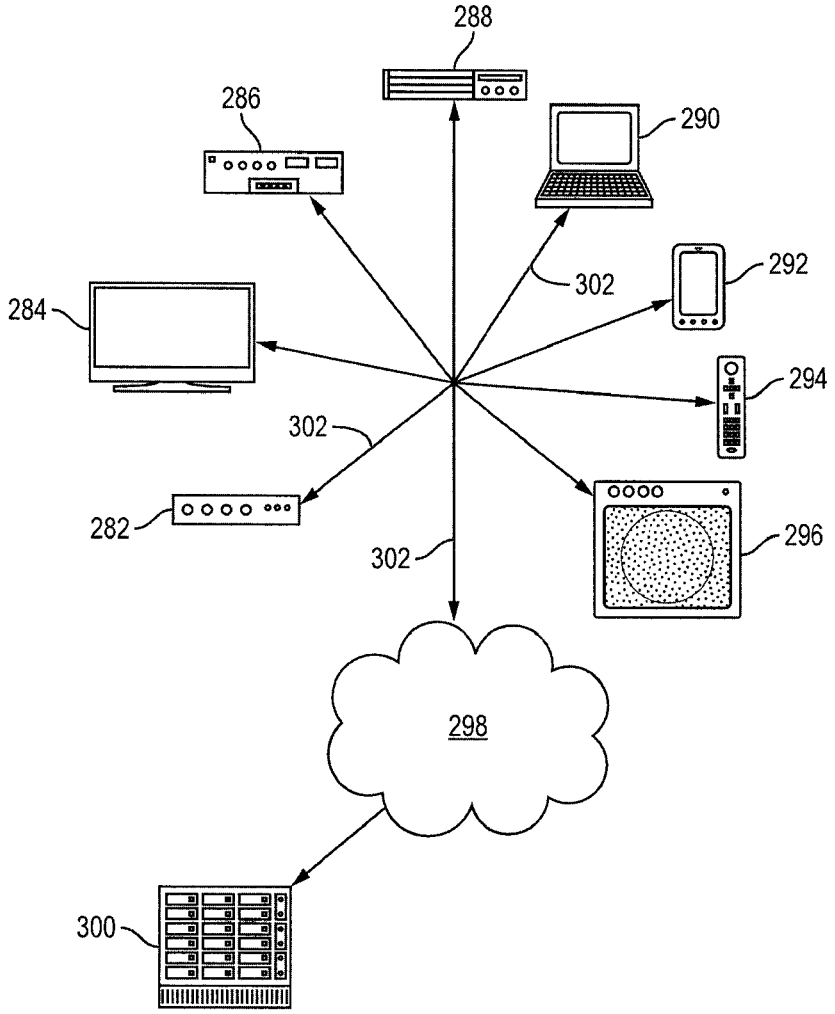
FIG. 12 illustrates audio and video equipment connected through an adhoc network.

FIG. 12 illustrates an adhoc communication network 280 for connecting, configuring, monitoring, and controlling audio and video equipment. In particular, communication network 280 includes satellite or cable receiver 282, TV or video display 284, audio and video amplifier 286, digital versatile disc (DVD) component 288, computer 290, mobile communication device 292, remote controller 294, speakers 296, external communication network 298, and server 300. Communication network 280 uses wired and wireless direct communication links 302 to send and receive analog or digital audio signals, control signals, and other data between devices 282-300. Each device 282-300 polls, identifies, and connects to any other device within the network through communication links 302. For example, satellite or cable receiver 282 polls, identifies, and connects to audio and video amplifier 286 through communication links 302; remote controller 294 polls, identifies, and connects to DVD component 288 through communication links 302; computer 290 polls, identifies, and connects to TV 284 through communication links 302; audio and video amplifier 286 polls, identifies, and connects to speaker 296 through communication links 302; mobile communication device 292 polls, identifies, and connects to external communication network 298 and server 300 through communication links 302. Any device 282-300 can communicate with any other device 282-300 through communication links 302 within communication network 280.

Consider an example where a user configures and utilizes devices 282-300. The user selects the configuration data using a web browser based interface, similar to FIGS. 5 and 6. The configuration data of devices 282-300 is stored on computer 290, mobile communication device 292, or internal memory of any device. The configuration data is transmitted from computer 290 or mobile communication device 292 through communication links 302 to devices 282-300. For satellite or cable receiver 282, the configuration data selects channel, volume, and programming features. For audio and video amplifier 286, the configuration data selects volume, speaker selection, and signal processing features. The configuration data of TV 284, DVD component 288, remote controller 294, and speakers 296 is also stored on computer 290, mobile communication device 292, or internal memory of the device. The configuration data is transmitted from computer 290 or mobile communication device 292 through communication links 302 to devices 282-300.

Once devices 282-300 are configured, the user begins to watch and listen to the audio and video performance. The audio and video signals generated are transmitted through communication links 302 to each device, which performs the signal processing according to the configuration data. The configuration of devices 282-300 can be updated at any time during the audio and video performance according the configuration data set by user control interface. The configuration data is transmitted to devices 282-300 to change the signal processing of the audio and video signals in realtime.

In summary, a communication network connects, configures, monitors, and controls musical instruments and related accessories. The configuration data is transmitted from laptop computer 58 or mobile communication device 60 through WAP 28, cellular base station 22, or other wired or wireless connection to devices 54-68. The audio signals between MI 54-56 and musical related accessories 62-68 is also transmitted through WAP 28, cellular base station 22, or other wired or wireless connection. The devices within the communication network each contain a transceiver and controller for sending and receiving the audio signals and control data. The wireless format reduces or negates the need for physical cabling. Wireless communication network 50 or 210 reduces the cost, inconvenience, and hazards associated with physical cabling.

While one or more embodiments of the present invention have been illustrated in detail, the skilled artisan will appreciate that modifications and adaptations to those embodiments may be made without departing from the scope of the present invention as set forth in the following claims.

What is claimed:

1. A communication network for connecting and controlling a musical instrument, comprising:

a musical instrument including a first communication link disposed on the musical instrument;

an audio amplifier including a second communication link disposed on the audio amplifier;

an access point coupled to the musical instrument through the first communication link and the audio amplifier through the second communication link;

a first web server disposed on the musical instrument and configured to control the musical instrument in response to data received over the first communication link;

a second web server disposed on the audio amplifier and configured to control the audio amplifier in response to data received over the second communication link; and a user control interface coupled to the access point and configured to poll and identify the musical instrument and audio amplifier, wherein the user control interface displays a status of the musical instrument and audio amplifier and provides links to the first web server and second web server.

2. The communication network of claim 1, further including a music related accessory comprising a third communication link in communication with the access point.

3. The communication network of claim 2, wherein the music related accessory is selected from a group consisting of a speaker, effects pedal, display monitor, computer, audio recorder, special effect system, stage lighting, mobile communication device, and synthesizer.

4. The communication network of claim 1, wherein the musical instrument is selected from a group consisting of a guitar, violin, horn, brass, drums, wind instrument, string instrument, piano, organ, percussions, and microphone.

5. The communication network of claim 1, further including a server connected to the access point for receiving and storing an audio signal from the musical instrument.

6. The communication network of claim 1, wherein the audio amplifier further includes:

a controller coupled to the second communication link;

a memory coupled to the controller; and a signal processing circuit coupled to the controller and memory for configuring and operating the signal processing circuit.

7. The communication network of claim 1, wherein the user control interface includes a web interface.

8. The communication network of claim 1, wherein the user control interface allows for configuring the musical instrument via the first web server and audio amplifier via the second web server.

9. The communication network of claim 8, wherein the user control interface automatically displays the status of the musical instrument and audio amplifier.

10. A musical system, comprising:

a musical instrument;

a first communication link disposed on the musical instrument;

a controller coupled to the first communication link for receiving control data to control operation of the musical instrument and transmitting an audio signal originating from the musical instrument through the first communication link; and a musical related device coupled to receive control data from the musical instrument via the first communication link.

11. The musical system of claim 10, wherein the first communication link transmits and receives over wired or wireless medium.

12. The musical system of claim 10, wherein the musical instrument is selected from a group consisting of a guitar, violin, horn, brass, drums, wind instrument, string instrument, piano, organ, percussions, and microphone.

13. The musical system of claim 10, further including a music related accessory comprising a second communication link for transmitting and receiving an audio signal and control data.

14. The musical system of claim 13, wherein the music related accessory is selected from a group consisting of an audio amplifier, speaker, effects pedal, display monitor, computer, mobile communication device, and synthesizer.

15. The musical system of claim 10, further including a user control interface for configuring the musical instrument.

16. The musical system of claim 15, wherein the user control interface includes a graphical user interface for configuring the musical instrument.

17. The musical system of claim 10, further including a web interface for user selection and viewing of the control data in human perceivable form.

18. The musical system of claim 10, further including a server connected to the first communication link.

19. A musical system, comprising:

a musical related device including a communication link disposed on the musical related device;

a controller coupled for receiving control data through the communication link and transmitting an audio signal from the musical related device through the communication link;

an access point coupled to the controller through the communication link; and a user control interface connected to the controller through the access point and communication link and configured to detect the musical related device and display a status of the musical related device.

20. The musical system of claim 19, wherein the musical related device is selected from a group consisting of a guitar, violin, horn, brass, drums, wind instrument, string instrument, piano, organ, percussions, microphone, audio amplifier, speaker, and effects pedal.

21. The musical system of claim 19, further including a server connected to the access point.

22. The musical system of claim 19, wherein the user control interface includes a web interface for user selection and viewing of the control data.

23. The musical system of claim 19, wherein the user control interface allows for configuring the musical related device.

24. The musical system of claim 23, wherein the user control interface includes a graphical user interface for configuring the musical related device.

25. A communication system, comprising:

an audio or video device including a communication link disposed on the audio or video device;

a controller coupled for receiving control data to control operation of the audio or video device; and a web server on the audio or video device to serve a web page to a computer system for selection and viewing of the control data.

26. The communication system of claim 25, wherein the audio or video device is selected from a group consisting of a guitar, violin, horn, brass, drums, wind instrument, string instrument, piano, organ, percussions, microphone, audio amplifier, speaker, effects pedal, display monitor, synthesizer, satellite or cable receiver, TV, audio and video amplifier, DVD component, computer, mobile communication device, and remote controller.

27. The communication system of claim 25, further including a server connected to the communication link.

28. The communication system of claim 25, further including a user control interface for accessing the web page.

29. The communication system of claim 25, wherein the web page includes a graphical user interface for configuring the audio or video device.

30. A method of configuring and controlling a musical system, comprising:

providing a musical related device including a communication link disposed on the musical related device;

coupling the musical related device to a communication network through the communication link;

providing a user control interface coupled to the communication network;

automatically generating a user interface element in the user control interface to control the musical related device after coupling the musical related device to the communication network; and transmitting control data to the musical related device using the user control interface.

31. The method of claim 30, wherein the communication link transmits and receives over wired or wireless medium.

32. The method of claim 30, wherein the musical related device is selected from a group consisting of a guitar, violin, horn, brass, drums, wind instrument, string instrument, piano, organ, percussions, microphone, audio amplifier, speaker, and effects pedal.

33. The method of claim 30, further including providing a server connected to the communication link.

34. The method of claim 30, wherein providing the user control interface includes providing a web interface.

35. The method of claim 30, wherein the user control interface includes a graphical user interface for configuring the musical related device.

* * * * *